US006283787B1

(12) United States Patent
Chou

(10) Patent No.: US 6,283,787 B1
(45) Date of Patent: Sep. 4, 2001

(54) ELECTRIC OUTLET SHELL

(76) Inventor: Jonie Chou, 9F-4, No. 232, Chung Ho Road, Chung Ho City, Taipei Hsien (TW)

( * ) Notice: Subject to any disclaimer, the term of this patent is extended or adjusted under 35 U.S.C. 154(b) by 0 days.

(21) Appl. No.: 09/608,431

(22) Filed: Jun. 30, 2000

(51) Int. Cl.[7] ..... H01R 3/00
(52) U.S. Cl. ..... 439/488
(58) Field of Search ..... 439/488, 490, 439/607, 676, 619, 717, 491, 136, 145

(56) References Cited

U.S. PATENT DOCUMENTS 5,026,300 * 6/1991 Varner ..... 439/371
5,139,440 * 8/1992 Volk et al. ..... 439/413
5,212,347 * 5/1993 Powers et al. ..... 174/67
5,267,870 * 12/1993 Maresh ..... 439/139
5,288,945 * 2/1994 Bruce ..... 174/67
5,291,678 * 3/1994 Murray ..... 40/564
5,299,943 * 4/1994 Shieh ..... 439/136
5,393,237 * 2/1995 Roy et al. ..... 439/134
5,449,860 * 9/1995 Buckshaw et al. ..... 174/67
5,574,625 * 11/1996 Ohgami et al. ..... 361/684
5,589,718 * 12/1996 Lee ..... 307/72
5,997,318 * 12/1999 Chou ..... 439/136
6,135,820 * 10/2000 Chiang ..... 439/654

* cited by examiner

*Primary Examiner*—Gary Paumen
*Assistant Examiner*—Phuongchi Nguyen
(74) *Attorney, Agent, or Firm*—Dougherty & Troxell

(57) ABSTRACT

An electric outlet shell having a plurality of electric plug receiving units, each electric plug receiving unit having a flat bearing surface with at least two insertion slots adapted for receiving an electric plug, wherein mark means is respectively provided at the flat bearing surface of each electric plug receiving unit so that the user can distinguish the electric plug receiving units from one another.

5 Claims, 3 Drawing Sheets

ELECTRIC OUTLET SHELL

BACKGROUND OF THE INVENTION

1. Field of The Invention

The present invention relates to a shell for an electric outlet, and more particularly to such an electric outlet shell, which comprises a plurality of electric plug receiving units respectively marked with respective mark means so that the user can distinguish the electric plug-receiving units from one another.

2. Description of Related Art

A variety of electric outlets have been disclosed for power supply output, and have appeared on the market. In offices or houses, a variety of electric and electronic apparatus, such as stereo equipment, TV, VCD or DVD player, air-conditioner, electric fan, personal computer, computer peripheral apparatus, and etc. may be installed in different electric plug receiving units of a common electric outlet to obtain power supply.

When different electric and/or electronic apparatus are connected to the electric plug-receiving units of a common electric outlet, the power cords or cables of the electric and/or electronic apparatus may be tangled. In this case, the user may be unable to distinguish the power cords or cables from one another.

SUMMARY OF THE INVENTION

The invention has been accomplished under the circumstances in view. According to one aspect of the present invention, the electric outlet shell comprises a plurality of electric plug receiving units, each electric plug receiving unit having a flat bearing surface with at least two insertion slots adapted for receiving an electric plug, and mark means respectively provided at the flat bearing surface of each electric plug receiving unit for enabling the user to distinguish the electric plug receiving units from one another.

According to another aspect of the present invention, the mark means are differently colored stickers respectively adhered to the flat bearing surface of each electric plug receiving unit.

BRIEF DESCRIPTION OF THE DRAWINGS

The present invention can be more fully understood by referring to the following description and accompanying drawing, in which.

DETAILED DESCRIPTION OF THE PREFERRED EMBODIMENTS

Figure 1:
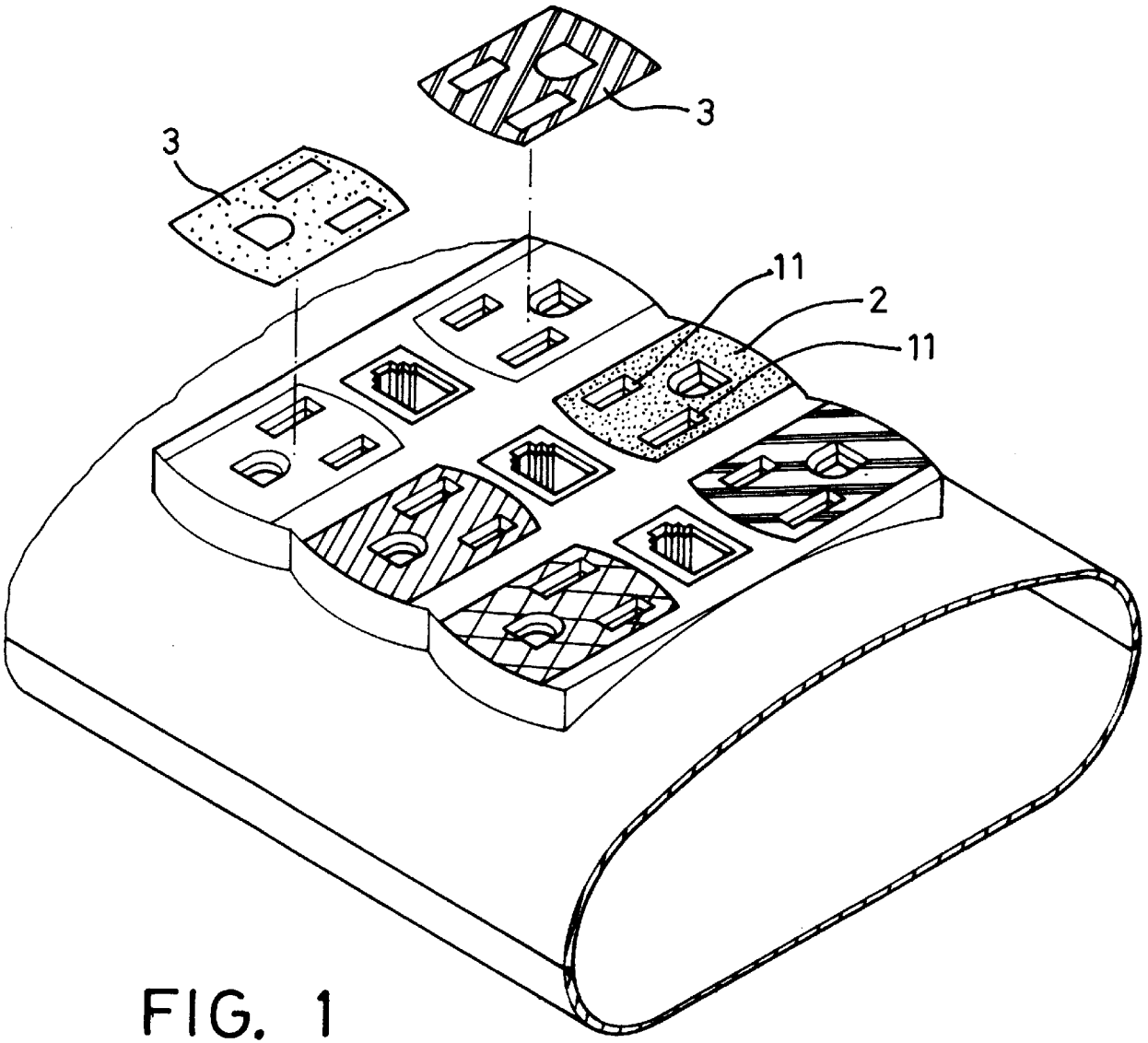
FIG. 1 is an exploded view of an electric outlet shell according to one embodiment of the present invention.
Figure 2:
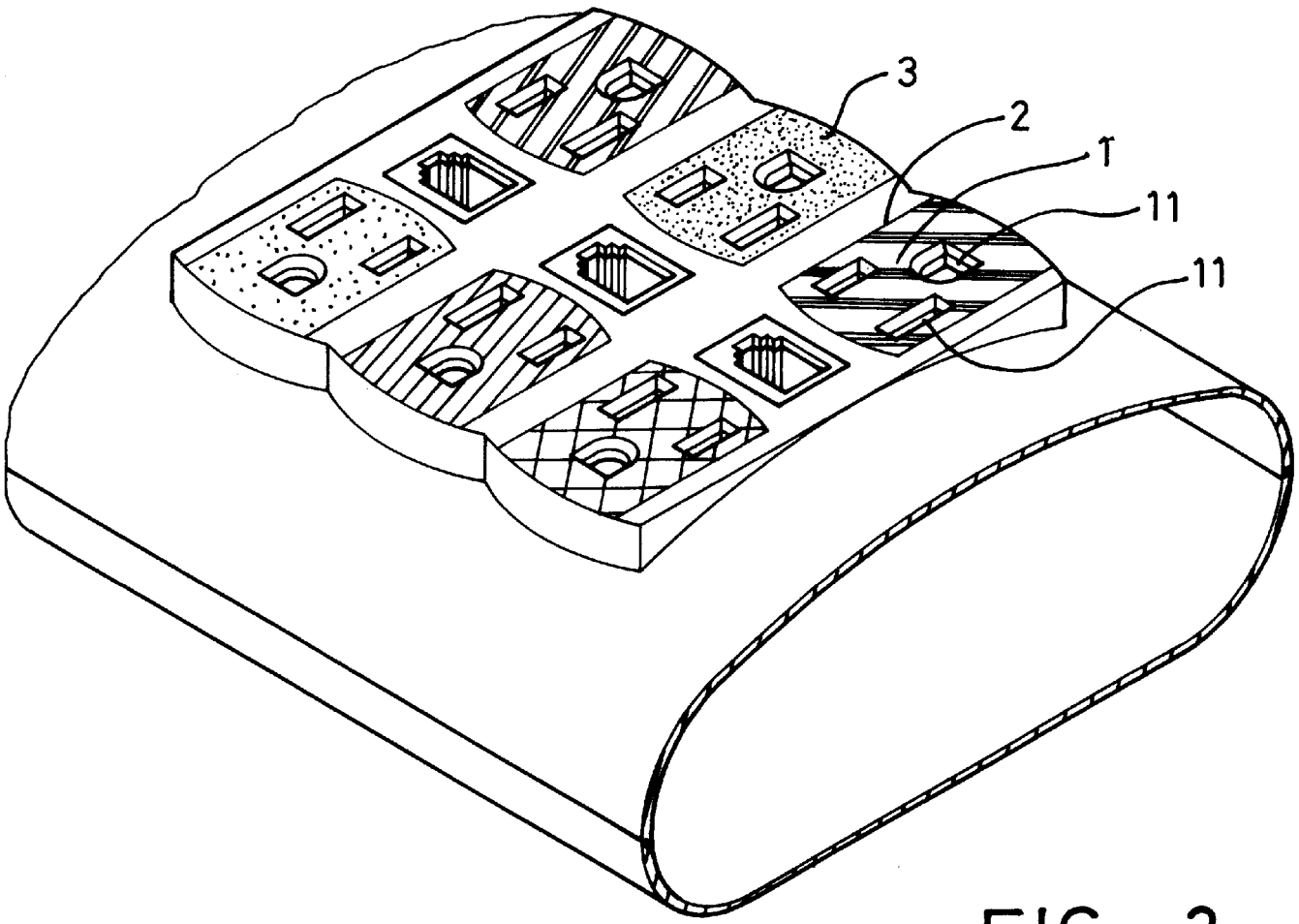
FIG. 2 is an assembly view of FIG. 1.

Referring to FIGS. 1 and 2, an electric outlet shell in accordance with the present invention comprises a plurality of electric plug receiving units 1, each electric plug receiving unit 1 having at least two insertion slots 11. For example, the electric outlet shell comprises six electric plug-receiving units 1, each electric plug receiving unit 1 having three insertion slots 11.

Referring to FIGS. 1 and 2 again, each electric plug-receiving unit 1 has a flat bearing surface 2 within which the respective electric plug insertion slots 11 are disposed. The flat bearing surface 2 has a rectangular shape with the two short sides thereof smoothly arched.

Referring to FIGS. 1 and 2 again, marks 3 are provided to show the difference in between each two adjacent electric plug-receiving units 1. The marks 3 can have any of a variety of forms. For example, the marks 3 are differently colored coverings respectively covered on the flat bearing surface 2 of each electric plug-receiving unit 1. The differently colored coverings can be stickers of paper, polymer, or any of a variety of materials respectively adhered to the flat bearing surface 2 of each electric plug receiving unit 1. Of course, each covering has holes in it corresponding to the electric plug insertion slots 11 on the respective electric plug-receiving unit 1.

Figure 3:
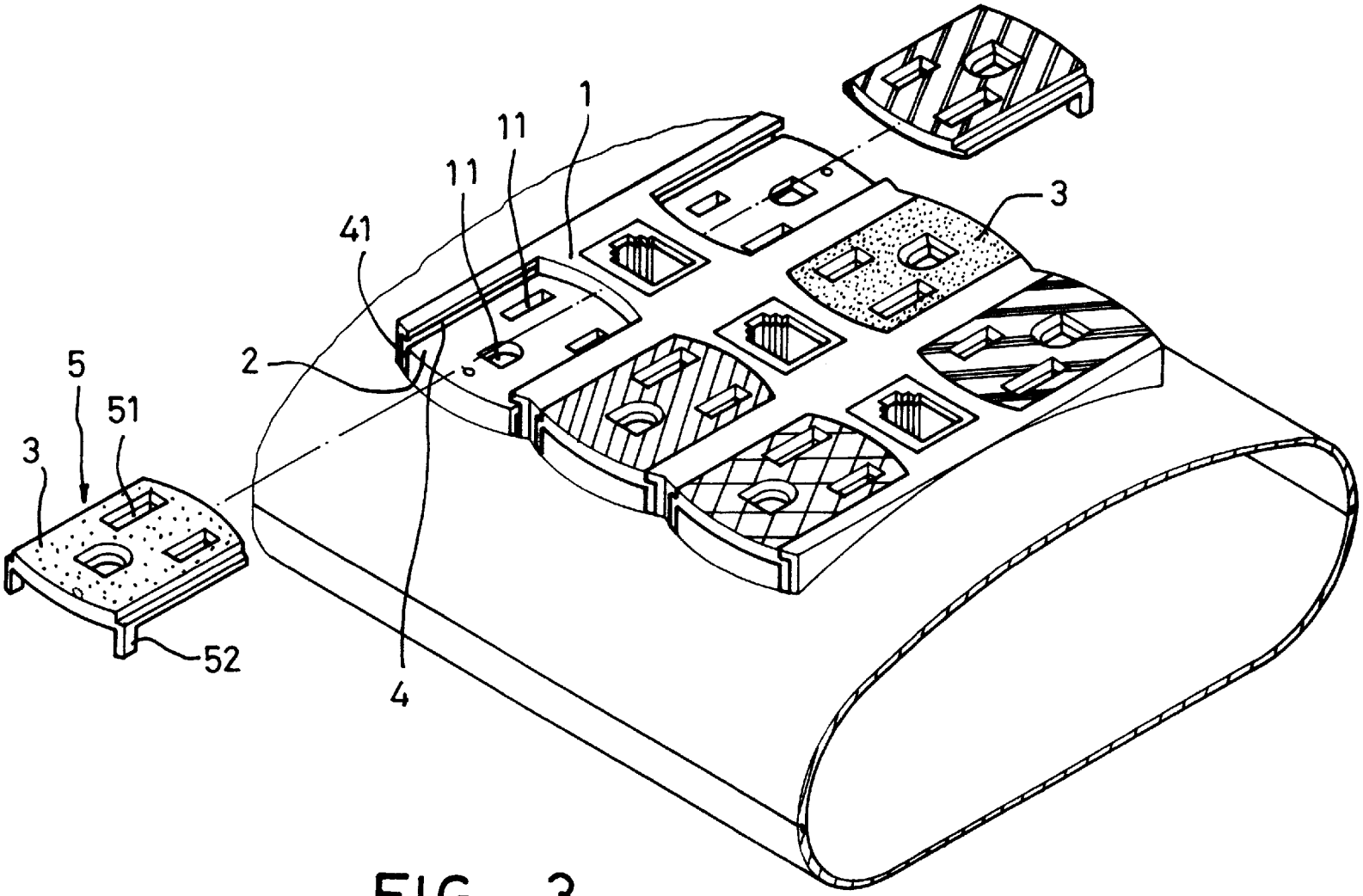
FIG. 3 is an exploded view of an alternate form of the present invention.

Referring to FIG. 3, as an alternate form of the present invention, each electric plug receiving unit 1 comprises two tracks 4 respectively extended along the two opposite long sides and above the elevation of the respective flat bearing surface 2, and two sliding grooves 41 respectively extended along the two opposite long sides of respective flat bearing surface 2 and linked to the tracks 4 at right angles, and the marks 3 are made on respective insertion plates 5 adapted for inserting into the tracks 4 in each electric plug receiving unit 1. Each insertion plate 5 comprises a plurality of insertion slots 51 corresponding to the electric plug insertion slots 11 on the respective electric plug receiving unit 1, and two bottom guide rods 52, which are moved into the respective sliding grooves 41 upon insertion of the respective insertion plate 5 into the tracks 4 of the corresponding electric plug receiving unit 1.

As indicated above, the electric plug receiving units 1 are provided with respective marks 3 so that the user can distinguish the electric plug receiving units 1 from one another.

It is to be understood that the drawings are designed for purposes of illustration only, and are not intended for use as a definition of the limits and scope of the invention disclosed.

What is claimed is:

1. An electric outlet shell comprising:

a) a flat surface having at least one side edge;

b) a plurality of recesses in the flat surface, each recess having opposite lateral sides and opening outwardly from the at least one side edge, each recess having at least two first electric plug insertion slots;

c) a track extending along a length of each lateral side;

d) a sliding groove communicating with and extending at a right angle to each track;

e) a plurality of insertion plates, each having at least two second electric plug insertion slots therethrough and two guide rods extending therefrom, each insertion plate slidably engaging the tracks on opposite lateral sides of one of the plurality of recesses such that the insertion plate is movable from a use position, in which the second electric plug insertion slots are aligned with the first electric plug insertion slots, thereby enabling an electric plug to engage the first electric plug insertion slots by passing through the second electric plug insertion slots, and in which the guide rods engage the sliding grooves, to a position removed from the flat surface by sliding outwardly from the at least one edge; and, f) indicia on a surface of each insertion plate, whereby the indicia on each insertion plate is different from the indicia on the others of the plurality of insertion plates.

2. The electric outlet shell of claim 1 wherein the indicia comprises a color.

3. The electric outlet shell of claim 1 wherein the indicia comprises a visible pattern.

4. The electric outlet shell of claim 1 wherein the indicia comprises letters.

5. The electric outlet shell of claim 1 wherein the indicia comprises numbers.

* * * * *